US009643417B2

(12) United States Patent
Ezaki et al.

(10) Patent No.: US 9,643,417 B2
(45) Date of Patent: May 9, 2017

(54) METHOD FOR FORMING SILICONE-BASED CURED FILM ON INK DISCHARGE SURFACE OF NOZZLE PLATE FOR INKJET PRINTER, AND NOZZLE PLATE

(71) Applicant: RISO KAGAKU CORPORATION, Tokyo (JP)

(72) Inventors: Naofumi Ezaki, Ibaraki (JP); Yoshifumi Watanabe, Ibaraki (JP); Tetsuo Hosoya, Ibaraki (JP)

(73) Assignee: RISO KAGAKU CORPORATION, Tokyo (JP)

( * ) Notice: Subject to any disclaimer, the term of this patent is extended or adjusted under 35 U.S.C. 154(b) by 0 days.

(21) Appl. No.: 14/414,587

(22) PCT Filed: May 16, 2013

(86) PCT No.: PCT/JP2013/063677

§ 371 (c)(1),
(2) Date: Jan. 13, 2015

(87) PCT Pub. No.: WO2014/013783

PCT Pub. Date: Jan. 23, 2014

(65) Prior Publication Data

US 2015/0174904 A1 Jun. 25, 2015

(30) Foreign Application Priority Data

Jul. 20, 2012 (JP) ..... 2012-161249

(51) Int. Cl.

| | |
|---|---|
| ***B05D 3/02*** | (2006.01) |
| ***B41J 2/16*** | (2006.01) |
| ***B41J 2/14*** | (2006.01) |

(52) U.S. Cl.
CPC ..... *B41J 2/162* (2013.01); *B41J 2/1433* (2013.01); *B41J 2/1606* (2013.01); *B41J 2/1645* (2013.01)

(58) Field of Classification Search
CPC ..... B41J 2/1433; B41J 2/1645; B41J 2/162; B41J 2/1606

(Continued)

(56) References Cited

U.S. PATENT DOCUMENTS

2003/0069379 A1* 4/2003 Inoue ..... C08L 83/04 528/12
2008/0299400 A1* 12/2008 Furuya ..... C08L 83/04 428/447
2010/0245476 A1* 9/2010 Ohkuma ..... B41J 2/1603 347/45

FOREIGN PATENT DOCUMENTS

EP 1535972 A1 * 6/2005 ..... B05D 3/0209
JP 2002-161373 6/2002

(Continued)

OTHER PUBLICATIONS

International Search Report, mailed Aug. 6, 2013 for Patent Application No. PCT/JP2013/063677.

(Continued)

*Primary Examiner* — Robert S Walters, Jr.
(74) *Attorney, Agent, or Firm* — Greenblum & Bernstein, P.L.C.

(57) ABSTRACT

A nozzle plate which exhibits excellent ink repellency and excellent durability to wiping, even when used with an ink that adheres readily to the nozzle plate is provided. A method for forming a silicone-based cured film on the ink discharge surface of a nozzle plate for an inkjet printer, the method comprising: (1) a step of preparing a condensation-type silicone composition containing at least one compound selected from the group consisting of bismuth compounds (Continued)

and cyclic amidine compounds, (2) a step of applying this condensation-type silicone composition to the ink discharge surface of the nozzle plate to form a coating film, and (3) a step of heating and curing this coating film.

8 Claims, 1 Drawing Sheet

(58) Field of Classification Search
USPC ..... 427/387
See application file for complete search history.

(56) References Cited

FOREIGN PATENT DOCUMENTS

| | | | |
|---|---|---|---|
| JP | 2003-119387 | | 4/2003 |
| JP | 2006-82362 | | 3/2006 |
| JP | 2006-289838 | | 10/2006 |
| JP | 2007-190818 | | 8/2007 |
| JP | 2007-253610 | A | 10/2007 |
| WO | 2005/007413 | A1 | 1/2005 |
| WO | 2011/077996 | A1 | 6/2011 |

OTHER PUBLICATIONS

International preliminary report on patentability for Patent Application No. PCT/JP2013/063677, mail date is Jan. 29, 2015.
Search Report issued by European Patent Office (EPO) in EPO Patent Application No. 13819771.0, dated Jul. 8, 2016.

* cited by examiner

METHOD FOR FORMING SILICONE-BASED CURED FILM ON INK DISCHARGE SURFACE OF NOZZLE PLATE FOR INKJET PRINTER, AND NOZZLE PLATE

TECHNICAL FIELD

The present invention relates to a method for forming a silicone-based cured film on the ink discharge surface of the nozzle plate for an inkjet printer, and also relates to a nozzle plate. Specifically, the invention relates to a method for forming a cured film on the ink discharge surface using a specific compound, and a nozzle plate which, by applying this method, can be provided with a cured film that is resistant to soiling, and exhibits excellent durability to wiping during cleaning.

BACKGROUND ART

Inkjet printers discharge ink droplets from a nozzle plate to form an image on a recording medium. In order to prevent ink and the like adhering to the nozzle plate, the nozzle plate is usually coated with a ink-repellent cured film formed from a fluororesin or the like, but the adhesion of dust and foreign matter and the like cannot be totally prevented. Accordingly, the nozzle plate is usually subjected to cleaning periodically. The most commonly employed cleaning method is a method in which the nozzle plate is wiped with a blade.

However, when wiping is performed, abrasion of the cured film occurs, causing a deterioration in the ink repellency and generating ink discharge problems. One method which has been proposed to address these problems is a method that employs a non-contact mode in which the blade does not contact the nozzle plate (Patent Document 1).

On the other hand, methods for improving the durability of the cured film on the nozzle plate have also been proposed. For example, a cured film formed from liquid-repellent particles containing fluorine atoms and silicon atoms (Patent Document 2), and a cured film formed from a base film containing silicon and a fluorine-containing silane coupling agent formed on top of the base film (Patent Document 3) have been proposed. Further, silicone-based cured films which exhibit excellent ink repellency and wiping resistance are also known (Patent Document 4).

Patent Document 1: JP 2007-190818 A

Patent Document 2: JP 2006-82362 A

Patent Document 3: JP 2006-289838 A

Patent Document 4: WO 2011/077996

However, as inks are improved in terms of image density and the like, the use of materials which adhere more readily to the nozzle plate than conventional inks is sometimes unavoidable, and therefore further improvements in the ink repellency of the nozzle plate are required. Accordingly, an object of the present invention is to provide a nozzle plate which exhibits excellent ink repellency and excellent durability to wiping (hereafter referred to as "wiping resistance"), even when used with an ink that adheres readily to the nozzle plate.

SUMMARY OF THE INVENTION

In other words, the present invention provides a method for forming a silicone-based cured film on the ink discharge surface of a nozzle plate for an inkjet printer, the method comprising:

(1) a step of preparing a condensation-type silicone composition comprising at least one compound selected from the group consisting of bismuth compounds and cyclic amidine compounds, (2) a step of applying the condensation-type silicone composition to the ink discharge surface of the nozzle plate to form a coating film, and (3) a step of heating and curing the coating film.

Further, the present invention also provides a nozzle plate for an inkjet printer, wherein the nozzle plate has a silicone-based cured film on the ink discharge surface of the nozzle plate, and the cured film comprises at least one compound selected from the group consisting of bismuth compounds and cyclic amidine compounds.

EMBODIMENTS FOR CARRYING OUT THE INVENTION

Figure 1:
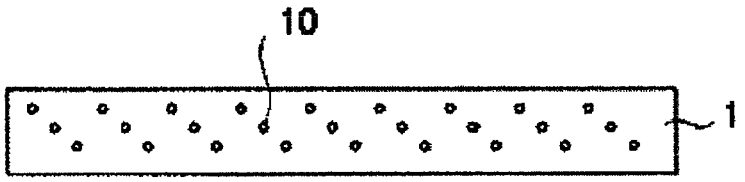
FIG. 1 is a front view illustrating one example of a nozzle plate.

Many compounds are used as compounds for curing condensation-type silicone compositions, including organic titanium compounds, tin carboxylates, amines and alkali metal salts. Surprisingly, it was discovered that, among these compounds, by using at least one compound selected from the group consisting of bismuth compounds and cyclic amidine compounds, a cured film having particularly superior ink repellency and wiping resistance could be obtained. A nozzle plate of the present invention provided with such a cured film has excellent ink repellency and wiping resistance, even relative to inks which exhibit high image density but adhere comparatively readily to the nozzle plate.

In the method of the present invention, first (1) a condensation-type silicone composition comprising at least one compound selected from the group consisting of bismuth compounds and cyclic amidine compounds is prepared. Examples of the bismuth compounds include inorganic bismuth compounds such as bismuth nitrate, bismuth bromide, bismuth iodide and bismuth sulfide, organic bismuth compounds such as dibutyl bismuth dilaurate and dioctyl bismuth dilaurate, and bismuth salts of organic acids such as bismuth 2-ethylhexanoate, bismuth naphthenate, bismuth octylate, bismuth isodecanoate, bismuth neodecanoate, bismuth laurate, bismuth maleate, bismuth stearate, bismuth oleate, bismuth linoleate, bismuth acetate, bismuth bisneodecanoate, bismuth disalicylate and bismuth digallate. Among these, bismuth salts of organic acids are preferred.

Examples of the cyclic amidine compounds include compounds having a diazabicyclo structure such as diazabicycloundecene and diazabicyclononene, and cyclic amidine salts of these structures such as the phenol salts, octylate salts, formate salts and oleate salts; imidazole derivatives such as methylimidazole and phenylimidazole; imidazoline derivatives such as methylimidazoline and dimethylimidazoline; and pyrimidine derivatives, but among these, the use of diazabicycloundecene or diazabicyclononene is preferable.

The above compound is preferably added in an amount of 0.01 to 5.0 parts by mass, more preferably 0.1 to 3.0 parts by mass, and still more preferably 0.2 to 1.0 parts by mass, per 100 parts by mass of the solid fraction of the condensation-type silicone composition described below, thus forming a condensation-type silicone composition for coating.

The resin fraction of the condensation-type silicone composition (hereafter sometimes referred to as simply the "silicone composition") preferably comprises (A) an organopolysiloxane resin, (B) a (meth)acrylic-based copolymer, and (c) a linear polysiloxane diol.

The organopolysiloxane resin (A) is a polysiloxane having a crosslinked structure obtained by hydrolysis-condensation of an alkoxyorganosilane compound represented by formula (I) shown below:

$$R^2_mSi(OR^1)_{4-m} \quad (I)$$

(wherein $R^1$ and $R^2$ represent monovalent hydrocarbon groups, and m represents an integer of 0 to 2), and may also include silica.

Examples of $R^2$ include substituted or unsubstituted monovalent hydrocarbon groups having a carbon number of 1 to 8. Specific examples include alkyl groups such as a methyl group, ethyl group, propyl group, butyl group, pentyl group, hexyl group, heptyl group and octyl group; cycloalkyl groups such as a cyclopentyl group and cyclohexyl group; aralkyl groups such as a 2-phenylethyl group and 3-phenylpropyl group; aryl groups such as a phenyl group and tolyl group; alkenyl groups such as a vinyl group and allyl group; halogen-substituted hydrocarbon groups such as a chloromethyl group, γ-chloropropyl group and 3,3,3-trifluoropropyl group; and substituted hydrocarbon groups such as a γ-methacryloxypropyl group, γ-glycidoxypropyl group, 3,4-epoxycyclohexylethyl group and γ-mercaptopropyl group. Among these, in terms of the ease of synthesis, availability, and suppression of any deterioration in hardness, an alkyl group having a carbon number of 1 to 4 or a phenyl group is preferable. Further, alkyl groups having a carbon number of 1 to 4 are typically used as $R^1$, and a methyl group is preferable.

Examples of tetraalkoxysilanes in which m=0 include tetramethoxysilane and tetraethoxysilane, and examples of organotrialkoxysilanes in which m=1 include methyltrimethoxysilane, methyltriethoxysilane, methyltriisopropoxysilane, phenyltrimethoxysilane, phenyltriethoxysilane and 3,3,3-trifluoropropyltrimethoxysilane. Further, examples of diorganodialkoxysilanes in which m=2 include dimethyldimethoxysilane, dimethyldiethoxysilane, diphenyldimethoxysilane, diphenyldiethoxysilane and methylphenyldimethoxysilane.

In formula (I), an alkoxyorganosilane compound ($A_1$) in which m=0, an alkoxyorganosilane compound ($A_2$) in which m=1 and an alkoxyorganosilane compound ($A_3$) in which m=2 are mixed as appropriate, and a hydrolysis-condensation is performed in an appropriate solvent in the presence of a curing agent such as water. Colloidal silica may be used instead of, or in addition to, the alkoxyorganosilane compound ($A_1$). The proportions used of ($A_1$) to ($A_3$) are set so that, relative to 100 parts by mass of ($A_1$), the amount of ($A_2$) is from 20 to 200 parts by mass, preferably from 40 to 160 parts by mass, and more preferably from 60 to 120 parts by mass, and the amount of ($A_3$) is from 0 to 60 parts by mass, preferably from 0 to 40 parts by mass, and more preferably from 0 to 30 parts by mass. When colloidal silica is used as ($A_1$), the above mass includes the dispersion medium.

Examples of the solvent used during the hydrolysis-condensation reaction include lower aliphatic alcohols such as methanol, ethanol, isopropanol, n-butanol and isobutanol; ethylene glycol derivatives such as ethylene glycol, ethylene glycol monobutyl ether and ethylene glycol monoethyl ether acetate; diethylene glycol derivatives such as diethylene glycol and diethylene glycol monobutyl ether; and diacetone alcohol, and either one solvent or two or more solvents selected from this group of solvents may be used. Examples of solvents which may be used in combination with the above hydrophilic organic solvents include toluene, xylene, ethyl acetate, butyl acetate, methyl ethyl ketone, methyl isobutyl ketone and methyl ethyl ketone oxime. Water may be used as the curing agent.

The obtained organopolysiloxane resin (A) has a styrene-equivalent weight-average molecular weight that is preferably from 800 to 3,000, and more preferably from 900 to 2,000.

The (meth)acrylic-based copolymer (B) has the effect of improving the toughness of the cured film. The (meth) acrylic-based copolymer (B) is a copolymer of at least the first, second and third (meth)acrylate ester monomers described below, and contains epoxy groups together with alkoxysilyl groups and/or halogenated silyl groups.

The (meth)acrylic-based copolymer (B) can be produced by performing a polymerization, in the presence of a catalyst such as azobisisobutyronitrile, of monomers represented by formula (II) shown below:

$$CH_2{=}CR^3(COOR^4) \quad (II)$$

(wherein $R^3$ represents a hydrogen atom or a methyl group), including a first monomer in which $R^4$ represents a substituted or unsubstituted monovalent group having a carbon number of 1 to 9, a second monomer in which $R^4$ represents a group containing an epoxy group, and a third monomer in which $R^4$ represents a group containing an alkoxysilyl group and/or a halogenated silyl group.

Examples of $R^4$ in the first monomer include alkyl groups such as a methyl group, ethyl group, propyl group, butyl group, pentyl group, hexyl group, heptyl group and octyl group; cycloalkyl groups such as a cyclopentyl group and cyclohexyl group; aralkyl groups such as a 2-phenylethyl group, 2-phenylpropyl group and 3-phenylpropyl group; aryl groups such as a phenyl group and tolyl group; halogenated hydrocarbon groups such as a chloromethyl group, γ-chloropropyl group and 3,3,3-trifluoropropyl group; and hydroxy hydrocarbon groups such as a 2-hydroxyethyl group, and among these, a methyl group, ethyl group, propyl group or butyl group is preferable.

Examples of $R^4$ in the second monomer include an epoxy group and a glycidyl group, and a glycidyl group is preferable.

Examples of $R^4$ in the third monomer include a trimethoxysilylpropyl group, dimethoxymethylsilylpropyl group, monomethoxydimethylsilylpropyl group, triethoxysilylpropyl group, diethoxymethylsilylpropyl group, ethoxydimethylsilylpropyl group, trichlorosilylpropyl group, dichloromethylsilylpropyl group, chlorodimethylsilylpropyl group, chlorodimethoxysilylpropyl group and dichloromethoxysilylpropyl group, and among these, a trimethoxy group is preferable.

The ratio (mass ratio) of the aforementioned first monomer:second monomer:third monomer is preferably (5 to 7):(3 to 4):(0.5 to 2). Further, the molecular weight of the (meth)acrylic-based copolymer (B), reported as a styrene-equivalent weight-average molecular weight, is preferably from 800 to 50,000, and more preferably from 800 to 20,000.

The linear polysiloxane diol (C) is represented by formula (In) shown below.

$$OH(R^5_2SiO)_nH \quad (III)$$

In this formula, $R^5$ represents an alkyl group having a carbon number of 1 to 3, and is preferably a methyl group. Further, n represents an integer of 3 to 100, preferably 3 to 50, more preferably 3 to 30, and further more preferably 10 to 20. It is thought that the linear polysiloxane diol (C) contributes to improvements in the water repellency and the oil repellency of the cured film surface.

The blend ratio between the organopolysiloxane resin (A), the (meth)acrylic-based copolymer (B) and the linear polysiloxane diol (C) is set so that, relative to 100 parts by mass of the organopolysiloxane resin (A), the amount of the (meth)acrylic-based copolymer (B) is from 1 to 100 parts by mass, and preferably from 5 to 30 parts by mass, and the amount of the linear polysiloxane diol (C) is from 1 to 100 parts by mass, and preferably from 5 to 30 parts by mass.

Prior to the application of the silicone composition in step (2), the surface of the nozzle plate is preferably subjected to a corona treatment or the like using a typical method in order to enhance the bond strength of the cured film. There are no particular limitations on the method used for applying the silicone composition, and dipping methods, methods using a bar coater, or spin coating methods may be used, but from the viewpoint of the uniformity of the coating film, a spin coating method is the more desirable. The thickness of the coating film should be sufficient to provide good wiping resistance, and is typically from 0.1 to 10 μm, and preferably from 0.2 to 5 μm. In step (3), the coating film of the applied silicone composition is cured at 100 to 150° C. to form a cured film.

There are no particular limitations on the structure of the nozzle plate, and as illustrated in FIG. 1, a structure in which a plurality of nozzles 10 are arranged at a predetermined pitch is appropriate. There are no limitations on the material for the nozzle plate 1, but a resin is preferable, and among the various resins, a polypropylene, polystyrene, polyamide, polyimide or polyester is preferable, and a polyimide is particularly preferable. The nozzle holes are perforated using a laser. This hole perforation is preferably performed after the cured film has been formed on the nozzle plate in accordance with the method of the present invention.

The blade used for wiping the nozzle plate is formed from a rubber such as an ethylene-propylene-diene rubber, styrene-butadiene rubber or fluorinated vinylidene rubber, and a blade formed from such a rubber coated with a fluorine coating may also be used. A fluororubber such as a fluorinated vinylidene rubber is preferably used.

The ink used for printing may be an arbitrary oil-based ink containing a pigment, an organic solvent and a pigment dispersant. Examples of pigments that can be used include organic pigments such as azo-based pigments, phthalocyanine-based pigments, dye-based pigments, condensed polycyclic pigments, nitro-based pigments and nitroso-based pigments (such as brilliant carmine 6B, lake red C, Watchung red, disazo yellow, Hansa yellow, phthalocyanine blue, phthalocyanine green, alkali blue and aniline black); inorganic pigments, including metals such as cobalt, iron, chromium, copper, zinc, lead, titanium, vanadium, manganese and nickel, as well as metal oxides and sulfides, and yellow ocher, ultramarine and iron blue pigments; and carbon blacks such as furnace carbon black, lamp black, acetylene black and channel black. Any one of these pigments may be used individually, or a combination of two or more pigments may be used.

From the viewpoints of dispersibility and storage stability, the average particle size of the pigment is preferably 300 nm or less, more preferably 150 nm or less, and still more preferably 100 nm or less. The average particle size of the pigment can be measured by a dynamic light scattering method. The amount of the pigment within the ink is typically from 0.01 to 20% by weight, and from the viewpoints of print density and ink viscosity, is preferably from 5 to 15% by weight.

Various substances can be used as the pigment dispersant, and examples include hydroxyl group-containing carboxylate esters, salts of long-chain polyaminoamides and high-molecular weight acid esters, salts of high-molecular weight polycarboxylic acids, salts of long-chain polyaminoamides and polar acid esters, high-molecular weight unsaturated acid esters, modified polyurethanes, modified polyacrylates, polyetherester anionic activators, naphthalenesulfonic acid formalin condensate salts, polyoxyethylene alkyl phosphate esters, polyoxyethylene nonyl phenyl ethers, polyester polyamines and stearylamine acetate.

Specific examples of polymer-based dispersants include those marketed under the product names listed below.

Solsperse 5000 (a phthalocyanine ammonium salt-based dispersant), 11200 (a polyamide-based dispersant), 13940 (a polyester amine-based dispersant), 17000 and 18000 (aliphatic amine-based dispersants), and 22000, 24000 and 28000 (all manufactured by Lubrizol Japan Ltd.);

Efka 400, 401, 402, 403, 450, 451 and 453 (modified polyacrylates), and Efka 46, 47, 48, 49, 4010 and 4055 (modified polyurethanes) (all manufactured by Efka Chemicals BV);

Demol P and EP, Poiz 520, 521 and 530, and Homogenol L-18 (polycarboxylate polymeric surfactants) (all manufactured by Kao Corporation);

Disparlon KS-860 and KS-873N4 (high-molecular weight polyester amine salts) (both manufactured by Kusumoto Chemicals, Ltd.);

Discol 202, 206, OA-202 and OA-600 (multi-chain polymeric nonionic dispersants) (all manufactured by Dai-ichi Kogyo Seiyaku Co., Ltd.); and Antaron V216 (a vinylpyrrolidone-hexadecene copolymer) (manufactured by ISP Japan Ltd.).

Among these, polyamide-based dispersants and vinylpyrrolidone-hexadecene copolymers are particularly desirable.

Further, examples of other pigment dispersants that can be used include copolymers of vinylpyrrolidone (VP) and alkenes having a carbon number of 10 to 40 (hereafter these copolymers are also referred to as "alkylated polyvinylpyrrolidone (alkylated PVP)"). Specific examples include copolymers of VP and an alkene selected from among decene, undecene, dodecene, tridecene, tetradecene, pentadecene, hexadecene, heptadecene, octadecene, nonadecene, icosene, eicosene, docosene and triacontene. Among these, copolymers with an alkene having a carbon number of 12 to 24 are preferred in terms of dispersion stability, and the use of a VP-hexadecene copolymer, VP-eicosene copolymer or VP-triacontene copolymer is particularly preferred. The copolymer may include a plurality of alkenes.

In terms of commercially available products, examples of VP-hexadecene copolymers include Antaron V-216 and Ganex V-216 manufactured by ISP Co., Ltd, and Unimer U-151 manufactured by Induchem AG, whereas examples of VP-eicosene copolymers include Antaron V-220 and Ganex V-220 manufactured by ISP Co., Ltd, and Unimer U-15 manufactured by Induchem AG.

Furthermore, combinations of a specific water-insoluble resin and a specific water-soluble resin can also be used favorably as the pigment dispersant. Examples of the specific water-insoluble resin include an acrylic-based dispersant resin composed of a copolymer of at least an alkyl (meth)acrylate (a) having an alkyl group with a carbon number of 8 to 18, and a monomer (b) having β-diketone group or β-keto acid ester group. The alkyl group with a carbon number of at least 8 to 18 exhibits excellent compatibility with the hydrocarbon-based non-polar solvent of the non-aqueous solvent described below, and consequently adopts a dissolved state in the non-aqueous solvent, whereas including the β-diketone group or β-keto acid ester group enables the viscosity of the ink to be reduced, and improves the low-temperature applicability. Further, this suppression of any increase in the viscosity also contributes to the electrostatic cohesion and fixation of the ink when the ink makes contact with the recording medium, resulting in improved print density and good suppression of show-through.

If the carbon number of the alkyl group is 19 or higher, then the acrylic-based dispersant resin tends to be prone to solidification at low temperature, and the low-temperature applicability deteriorates. On the other hand, if the carbon number is 7 or less, then the compatibility with the hydrocarbon-based non-polar solvent worsens, and the pigment is unable to be stably dispersed, resulting in a deterioration in the storage stability and an increase in the ink viscosity. Further, in a low-temperature environment, the ink viscosity increases even further, meaning the low-temperature applicability deteriorates. An alkyl group with a carbon number of 12 to 18 is particularly desirable.

The alkyl group with a carbon number of 8 to 18 may be either linear or branched. Specific examples include an octyl group, nonyl group, decyl group, dodecyl group, tridecyl group, tetradecyl group, pentadecyl group, hexadecyl group, heptadecyl group and octadecyl group, and a plurality of these groups may be included.

The β-diketone group is preferably an acetoacetyl group or propionacetyl group or the like, and the β-keto acid ester group is preferably an acetoacetoxy group or propionacetoxy group or the like.

There are no particular limitations on the molecular weight (weight-average molecular weight) of the acrylic-based dispersant resin, but when used within an ink for an inkjet, from the viewpoint of ink discharge properties, the molecular weight is preferably from approximately 5,000 to 50,000, and more preferably from approximately 10,000 to 30,000.

The glass transition temperature (Tg) of the acrylic-based dispersant resin is preferably normal temperature or lower, and is more preferably 0° C. or lower. This means that when the ink is fixed to the recording medium, film formation can be accelerated at normal temperature.

Preferred examples of the alkyl(meth)acrylate (a) include palmityl/stearyl methacrylate (C16/C18), cetyl acrylate (C16), dodecyl methacrylate (C12), dodecyl acrylate (C12), 2-ethylhexyl methacrylate (C8) and 2-ethylhexyl acrylate (C8). These compounds may be used individually, or in appropriate mixtures.

Preferred examples of the monomer (b) include (meth) acrylates and (meth)acrylamides containing a β-diketone group or β-keto acid ester group on the ester chain. More specific examples include acetoacetoxyalkyl(meth)acrylates such as acetoacetoxyethyl(meth)acrylate, hexadione(meth) acrylate, and acetoacetoxyalkyl(meth)acrylamides such as acetoacetoxyethyl(meth)acrylamide. These compounds may be used individually, or a combination of two or more compounds may be used.

The alkyl(meth)acrylate (a) and the monomer (b) are used in a mixture containing from 30 to 95% by mass, preferably 40 to 95% by mass, and more preferably 50 to 90% by mass of the alkyl(meth)acrylate (a), and from 3 to 30% by mass, and preferably 5 to 20% by mass of the monomer (b).

The above monomers can be easily polymerized by a conventional radical copolymerization. The reaction is preferably conducted as either a solution polymerization or a dispersion polymerization. In this case, in order to ensure that the molecular weight of the acrylic-based polymer following the polymerization satisfies the preferred range described above, the use of a chain transfer agent during polymerization is effective. Examples of compounds that can be used as this chain transfer agent include thiols such as n-butyl mercaptan, lauryl mercaptan, stearyl mercaptan and cyclohexyl mercaptan.

Examples of polymerization initiators that may be used include conventional thermal polymerization initiators, including azo compounds such as AIBN (azobisisobutyronitrile), and peroxides such as t-butyl peroxybenzoate and t-butylperoxy-2-ethylhexanoate (Perbutyl O, manufactured by NOF Corporation). Alternatively, a photopolymerization initiator may be used in which irradiation with an active energy beam is used to generate radicals. Petroleum-based solvents (such as aroma-free (AF) solvents) and the like can be used as the polymerization solvent used in a solution polymerization. This polymerization solvent is preferably one or more solvents selected from among those solvents (described below) that can be used, as is, for the non-aqueous solvent within the ink. During the polymerization reaction, other typically employed polymerization inhibitors, polymerization accelerators and dispersants and the like may also be added to the reaction system.

From the viewpoint of ensuring favorable storage stability, the amount of the acrylic-based dispersant resin relative to the pigment is preferably a mass ratio of 0.1 to 1.0. If the amount of the acrylic-based dispersant resin relative to the pigment is too small, and the mass ratio relative to the pigment is less than 0.1, or the amount is too large and the mass ratio exceeds 1.0, then maintaining good storage stability tends to become difficult.

The amount of the acrylic-based dispersant resin relative to the water-soluble resin is preferably a mass ratio of 0.1 to 20, and more preferably 0.4 to 10. If the amount of the acrylic-based polymer is too small, and the mass ratio relative to the water-soluble resin is less than 0.1, or the amount is too large and the mass ratio exceeds 20, then maintaining good storage stability tends to become difficult.

The mass of the resins (the combined mass of the acrylic-based dispersant resin and the water-soluble resin) relative to the mass of the pigment, when the mass of the pigment is deemed to be 1, is preferably at least 0.2 from the viewpoint of ensuring a good pigment dispersion effect, but is preferably not more than 1.5 from the viewpoints of avoiding any increase in the ink viscosity and avoiding discharge faults over time.

The amount of the water-soluble resin, reported as a mass ratio relative to the pigment, is preferably from 0.01 to 0.5, and more preferably from 0.05 to 0.3.

Relative to the total mass of the ink, the water-soluble resin is preferably included in an amount of 0.1 to 5% by mass, and more preferably 0.5 to 2% by mass.

Examples of the aforementioned specific water-soluble resin include basic polymer electrolytes such as polyethyleneimines (PEI), polyvinylamines and polyvinylpyridines, and derivatives thereof. Resins which can be used particularly favorably include polyethyleneimines having a weight-average molecular weight of 200 to 2,000, and modified polyethyleneimines formed by performing an addition reaction between a polyethyleneimine having a weight-average molecular weight of 200 to 2,000 and either an acrylate ester or a vinyl compound. In these modified polyethyleneimines, if the total amine value of the polyethyleneimine is deemed to be 1 molar equivalent, then the amount of the acrylate ester or the vinyl compound is preferably at least 0.3 molar equivalent but less than 1 molar equivalent (hereafter such compounds are simply referred to as "modified polyethyleneimines"). Here, the amine value is the value obtained by determining the amine value (mg KOH/g) using the (2) indicator titration method of JIS K-7237-1995 (Testing method for total amine values of amine-based hardeners of epoxide resins), and then calculating the molar value based on a KOH molecular weight of 56.11 mg/mmol. If the weight-average molecular weight of the polyethyleneimine is less than 200, then the effect of the ink in increasing the print density on plain paper is minimal, whereas if the weight-average molecular weight exceeds 2,000, then dependent upon the storage environment, the storage stability may deteriorate. The weight-average molecular weight of the polyethyleneimine is more preferably from 300 to 1,800, as this ensures a good density improvement effect and favorable storage stability at low temperature due to a pour point of −5° C. or lower.

Commercially available polyethyleneimines can be used, and examples of preferred products include SP-006, SP-012, SP-018 and SP-200, manufactured by Nippon Shokubai Co., Ltd., and Lupasol FG, Lupasol G20 Waterfree and Lupasol PR8515, manufactured by BASF Corporation.

Moreover, because of the alkyl group with a carbon number of 8 to 18 of the acrylic-based dispersant resin, the affinity with the hydrocarbon-based non-polar solvent of the non-aqueous solvent improves, and better solubility in the solvent is achieved, but if the affinity between the non-aqueous solvent and the pigment is too high, then the pigment tends to be drawn into the interior of the recording medium as the non-aqueous solvent penetrates into the recording medium. However, by using a combination of an acrylic-based dispersant resin and a water-soluble resin, favorable pigment dispersion stability can be ensured even if the amount of the acrylic-based dispersant resin is restricted, and therefore the amount of the acrylic-based dispersant resin can be reduced, thereby suppressing penetration of the pigment into the recording medium. As a result, show-through can be suppressed, and a high print density can be achieved.

The amount of the dispersant may be any amount that enables satisfactory dispersion of the above pigment within the ink, and is typically about 1 to 10% by weight of the total weight of the ink.

The organic solvent may be a non-polar organic solvent, a polar organic solvent, or a mixture thereof. A mixture composed of 20 to 60% by weight of a non-polar solvent and 80 to 40% by weight of a polar solvent is preferable, a mixture composed of 25 to 55% by weight of a non-polar solvent and 75 to 45% by weight of a polar solvent is more preferable, and a mixture composed of 30 to 50% by weight of a non-polar solvent and 70 to 50% by weight of a polar solvent is particularly desirable.

Examples of preferred non-polar organic solvents include aliphatic hydrocarbon solvents, alicyclic hydrocarbon solvents and aromatic hydrocarbon solvents. Specific examples of preferred aliphatic hydrocarbon solvents and alicyclic hydrocarbon solvents include paraffin-based, isoparaffin-based and naphthene-based solvents. Specific examples include the solvents marketed under the product names listed below, including Teclean N-16, Teclean N-20, Teclean N-22, Nisseki Naphtesol L, Nisseki Naphtesol M, Nisseki Naphtesol H, No. 0 Solvent L, No. 0 Solvent M, No. 0 Solvent H, Nisseki Isosol 300, Nisseki Isosol 400, AF-4, AF-5, AF-6 and AF-7 (all manufactured by JX Nippon Oil & Energy Corporation); and Isopar G, Isopar H, Isopar L, Isopar M, Exxsol D40, Exxsol D80, Exxsol D100, Exxsol D130 and Exxsol D140 (all manufactured by Exxon Mobil Corporation). Examples of aromatic hydrocarbon solvents include Nisseki Cleansol G (alkylbenzene) manufactured by IX Nippon Oil & Energy Corporation, and Solvesso 200 manufactured by Exxon Mobil Corporation. Among these, naphthene-based solvents, AF-4, AF-5, AF-6 and AF-7 (product names) are preferred.

Examples of solvents that can be used as the polar organic solvent include ester-based solvents, alcohol-based solvents, higher fatty acid-based solvents and ether-based solvents. For example, the use of one or more solvents selected from the group consisting of ester-based solvents that are esters of a higher fatty acid having a carbon number of 8 to 20 and an alcohol having a carbon number of 1 to 24, higher alcohols having a carbon number of 8 to 24, and higher fatty acids having a carbon number of 8 to 20 is particularly desirable.

Examples of the ester-based solvents include methyl laurate, isobutyl laurate, isopropyl laurate, hexyl laurate, isopropyl myristate, hexyl myristate, isopropyl palmitate, isostearyl palmitate, methyl oleate, ethyl oleate, isopropyl oleate, butyl oleate, methyl linoleate, isobutyl linoleate, ethyl linoleate, isopropyl isostearate, methyl soybean oil, isobutyl soybean oil, methyl tallate, isobutyl tallate, diisopropyl adipate, diisopropyl sebacate, diethyl sebacate, propylene glycol monocaprate, trimethylolpropane tri-2-ethylhexanoate and glyceryl tri-2-ethylhexanoate; examples of the alcohol-based solvents include isomyristyl alcohol, isopalmityl alcohol, isostearyl alcohol and oleyl alcohol; examples of the higher fatty acid-based solvents include isononanoic acid, isomyristic acid, hexadecanoic acid, isopalmitic acid, oleic acid and isostearic acid; and examples of the ether-based solvents include diethylene glycol monobutyl ether, ethylene glycol monobutyl ether, propylene glycol monobutyl ether and propylene glycol dibutyl ether. Among these, ester-based solvents, alcohol-based solvents, and mixtures thereof are preferable.

The organic solvent preferably has a 50% distillation point that is at least 100° C., and more preferably 200° C. or higher. The 50% distillation point is measured in accordance with JIS K0066 "Test Methods for Distillation of Chemical Products", and represents the temperature at which 50% of the mass of the solvent has volatilized.

In addition to the components described above, the ink composition may also contain commonly used additives, provided these additives do not impair the object of the present invention. Examples of these additives include surfactants, including anionic, cationic, amphoteric and non-ionic surfactants, and antioxidants such as dibutylhydroxytoluene, propyl gallate, tocopherol, butylhydroxyanisole and nordihydroguaiaretic acid.

The ideal range for the viscosity of the ink varies depending on factors such as the diameter of the discharge head nozzles in the inkjet recording system and the discharge environment, but generally, at 23° C., the viscosity is preferably from 5 to 50 mPa·s, more preferably from 5 to 20 mPa·s, and still more preferably 8 to 15 mPa·s. Provided the ink viscosity satisfies this range, inkjet discharge can be achieved by heating the inkjet discharge head or the like. Here, the viscosity is measured at 23° C. by raising the shear stress from 0 Pa at a rate of 0.1 Pa/s, and refers to the measured value at 10 Pa.

The inkjet printer may employ any of various printing systems, including a piezo system, electrostatic system or thermal system.

EXAMPLES

Examples of the present invention are described below, but the present invention is in no way limited to these examples.

<Preparation of Organopolysiloxane Resin (A)>

A 23% alcohol solution of an organopolysiloxane resin was prepared by mixing 100 parts of methyltrimethoxysilane, 90 parts of an acidic colloidal silica IPA dispersion (solid fraction: 30%), 100 parts of IPA and 37.7 parts of water, and then heating the mixture at 60° C. for 3 hours.

<Preparation of (Meth)Acrylic-Based Copolymer (B)>

First, 4.98 parts of n-butyl methacrylate, 2.48 parts of trimethoxysilylpropyl methacrylate, 0.71 parts of glycidyl methacrylate and 0.748 parts of γ-mercaptopropyltrimethoxysilane were dissolved in 9.26 parts of toluene, and a separate solution prepared by dissolving 0.025 parts of azobisisobutyronitrile in 3 parts of toluene was then added in a dropwise manner to effect a polymerization, thus yielding a liquid with a solid fraction of 40% containing a (meth)acrylic-based copolymer with a styrene-equivalent weight-average molecular weight of 1,000.

<Compounds for Silicone Compositions>

The following compounds were used as compounds for adding to the silicone compositions.

BiCAT8108 (a bismuth compound, manufactured by Shepherd Chemical Company)

DBU (diazabicycloundecene, manufactured by Wako Pure Chemical Industries,

Ltd.)

U-CAT SA1 (a phenol salt of DBU (diazabicycloundecene), manufactured by San-Apro Ltd.)

DBN (diazabicyclononene, manufactured by Wako Pure Chemical Industries, Ltd.)

Orgatix TC-750 (a titanium compound, manufactured by Matsumoto Fine Chemical Co., Ltd.)

Orgatix ZC-150 (a zirconia compound, manufactured by Matsumoto Fine Chemical Co., Ltd.)

BiCAT Z (a zinc compound, manufactured by Shepherd Chemical Company)

Potassium formate (manufactured by Wako Pure Chemical Industries, Ltd.)

Dibutyltin dilaurate (manufactured by Wako Pure Chemical Industries, Ltd.)

<Preparation of Silicone Compositions>

The various components were mixed in the proportions (parts by mass) shown in Table 3 to prepare a series of silicone compositions.

Examples 1 to 6, Comparative Examples 1 to 6

Using a spin coater, each of the silicone compositions with a formulation shown in Table 3 was applied to a non-perforated nozzle plate formed from a polyimide (product name: Kapton, manufactured by DuPont-Toray Co., Ltd.) that had undergone no surface treatment, thereby forming a film with a thickness of 1 μm, and the film was then cured at 150° C. for 12 hours to form a cured film.

In order to evaluate the thus obtained nozzle plates, a standard ink 1, and an ink 2 which produced a higher image density than ink 1 but adhered comparatively readily to the nozzle plate were used.

<Ink 1>

RISO X ink F black (manufactured by Riso Kagaku Corporation)

<Ink 2>

Ink 2 was prepared by the following method.

(Acrylic-Based Dispersant Resin Solution)

A 300 ml four-necked flask was charged with 75 g of AF-7 (a naphthene-based solvent, manufactured by JX Nippon Oil & Energy Corporation), and the temperature was raised to 110° C. while the solvent was stirred under a stream of nitrogen gas. Next, with the temperature held at 110° C., a monomer mixture containing the formulation (mass %) of monomers shown in Table 1 with a mixture prepared by adding 16.7 g of AF-7 and 2 g of Perbutyl O (t-butylperoxy-2-ethylhexanoate, manufactured by NOF Corporation) was added dropwise to the flask over a period of 3 hours. Subsequently, with the temperature maintained at 110° C., 0.2 g samples of Perbutyl O were added to the flask after one hour and then after 2 hours. The mixture was then heated at 110° C. for a further one hour, and was then diluted with 10.6 g of AF-7 to obtain a colorless and transparent acrylic-based dispersion resin solution X with a non-volatile fraction of 50%. The weight-average molecular weight of the thus obtained dispersant resin (measured by GPC method and referenced against standard polystyrenes) was 20,000 to 23,000.

TABLE 1

| | (Mass %) |
|---|---|
| Palmityl/stearyl methacrylate | 50.00 |
| Dodecyl methacrylate | 20.00 |
| Acetoacetoxyethyl methacrylate | 15.00 |
| Glycidyl methacrylate | 15.00 |

(Preparation of Ink 2)

Four grams of the obtained resin solution X was mixed with 1.5 g of a polyethyleneimine (SP-012, manufactured by Nippon Shokubai Co., Ltd.), 10 g of a pigment (MA100, a carbon black manufactured by Mitsubishi Chemical Corporation), 17.25 g of AF-7 and 17.25 g of hexyl laurate, zirconia beads (diameter: 0.5 mm) were added, and the mixture was dispersed for 120 minutes using a rocking mill (manufactured by Seiwa Technical Lab Co., Ltd.). Following dispersion, the zirconia beads were removed, the dispersion was diluted by adding 25 g of AF-7 and 25 g of Exeparl HL, and was then filtered sequentially through membrane filters of 3 μm and 0.8 μm to remove contaminants and any coarse particles, thus yielding an ink 2 with the formulation (mass %) shown in Table 2.

The thus obtained ink 2 was subjected to measurements of the average particle size of the pigment and the ink viscosity. The average particle size of the pigment was measured using a dynamic light scattering particle size distribution device LB-500 manufactured by Horiba, Ltd. The ink viscosity was measured at 23° C. by raising the shear stress from 0 Pa at a rate of 0.1 Pals and recording the measured value at 10 Pa, and was measured using a controlled stress rheometer RS75 manufactured by Haake GmbH (cone angle: 1°, diameter: 60 mm). The results are shown in Table 2.

TABLE 2

| | | | (Mass %) |
|---|---|---|---|
| Pigment | MA100 | | 10.00 |
| Water-insoluble resin | Acrylic-based dispersant resin solution X | Solid fraction 50% | 4.00 |
| Water-soluble resin | SP-012 | MW 1,200 | 1.50 |
| Diluting solvent during dispersion | AF-7 | Naphthene-based solvent | 17.25 |
| Diluting solvent during dispersion | HL | Hexyl laurate | 17.25 |
| Viscosity adjusting solvent | AF-7 | Naphthene-based solvent | 25.00 |
| Viscosity adjusting solvent | HL | Hexyl laurate | 25.00 |
| Total | | | 100.00 |
| Physical property | Average particle size (nm) | | 114 |
| Physical property | Viscosity (mPa · s) | | 9.3 |

<Evaluation of Ink Repellency>

Figure 2:
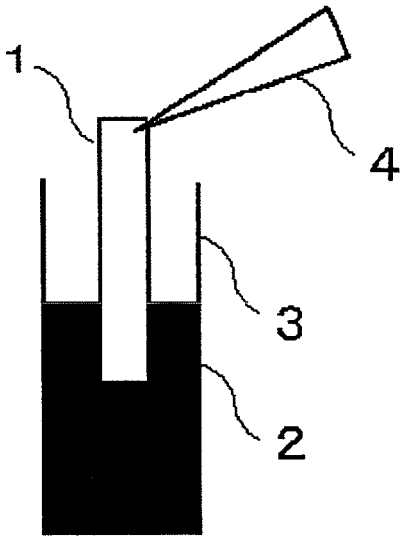
FIG. 2 is a schematic diagram illustrating the method for a lifting test performed in the examples.

As illustrated in FIG. 2, the ink was placed in a 30 ml container, one end of each nozzle plate 1 of the examples and comparative examples was grasped with a pair of tweezers 4, and 2 cm at the other end of the nozzle plate was dipped in the ink. Subsequently, the nozzle plate 1 was lifted rapidly out of the ink, and the time taken (seconds) for the ink film remaining on the nozzle plate to form ink droplets was measured. The measurement was repeated 10 times, the average of these values was recorded as the ink repellency time (seconds), and a time of less than 4 seconds was evaluated as A, a time of at least 4 seconds but less than 8 seconds was evaluated as B, and a time of 8 seconds or longer was evaluated as C. The results are shown in Table 3.

<Evaluation of Wiping Resistance>

Each of the inks with the formulations described above was dripped onto the cured film of the nozzle plate, and a blade made of a fluororubber (Viton MV454 53°, manufactured by DuPont Dow Elastomers LLC) was wiped across the nozzle plate at a rate of 200 back and forth movements per minute. The surface of the nozzle plate was inspected visually after every 1,000 back and forth movements, and the number of repetitions completed before the surface began to be wetted by the ink was counted. The contact force between the fluororubber and the nozzle plate was approximately $6\times10^{-2}$ N. The results are shown in Table 3. Wetting of the surface by the ink indicates damage to the cured film, and therefore a higher number of wiping repetitions indicates superior wiping resistance. A number of repetitions of 4,000 or greater was evaluated as A, a number of repetitions of at least 2,000 but less than 4,000 was evaluated as B, a number of repetitions of less than 2,000 was evaluated as C, and a number of repetitions of less than 1,000 was evaluated as D. The results are shown in Table 3.

TABLE 3

| | | | Example 1 | Example 2 | Example 3 | Example 4 | Example 5 | Example 6 | Comparative Example 1 |
|---|---|---|---|---|---|---|---|---|---|
| Silicone composition | (A) organopolysiloxane resin solution | solid fraction 23% | 100 | 100 | 100 | 100 | 100 | 100 | 100 |
| | (B) (meth)acrylic-based copolymer solution | solid fraction 40% | 5.75 | 5.75 | 5.75 | 5.75 | 5.75 | 5.75 | 5.75 |
| | (C) linear polysiloxane diol | Mw = 800 | 1.84 | 1.84 | 1.84 | 1.84 | 1.84 | 1.84 | 1.84 |
| | | Mw = 3,000 | 0.46 | 0.46 | 0.46 | 0.46 | 0.46 | 0.46 | 0.46 |
| | Compounds | BiCAT 8108 | 0.5 | | | | | | |
| | | DBN | | 0.5 | | | | | |
| | | DBU | | | 0.5 | 1 | 0.2 | | |
| | | U-CAT SA1 | | | | | | 0.5 | |
| | | Orgatix TC750 | | | | | | | |
| | | Orgatix ZC150 | | | | | | | |
| | | BiCAT Z | | | | | | | |
| | | potassium formate | | | | | | | |
| | | dibutyltin dilaurate | | | | | | | |
| | IPA | | 29.45 | 29.45 | 29.45 | 28.95 | 29.75 | 29.75 | 29.95 |
| Cured film evaluations | Ink repellency | Ink 1 | A | A | A | A | A | A | B |
| | | Ink 2 | A | A | A | A | A | A | B |
| | Wiping resistance | Ink 1 | A | A | A | A | A | A | C |
| | | Ink 2 | B | A | A | A | A | A | D |

| | | | Comparative Example 2 | Comparative Example 3 | Comparative Example 4 | Comparative Example 5 | Comparative Example 6 |
|---|---|---|---|---|---|---|---|
| Silicone composition | (A) organopolysiloxane resin solution | solid fraction 23% | 100 | 100 | 100 | 100 | 100 |
| | (B) (meth)acrylic-based copolymer solution | solid fraction 40% | 5.75 | 5.75 | 5.75 | 5.75 | 5.75 |
| | (C) linear polysiloxane diol | Mw = 800 | 1.84 | 1.84 | 1.84 | 1.84 | 1.84 |
| | | Mw = 3,000 | 0.46 | 0.46 | 0.46 | 0.46 | 0.46 |
| | Compounds | BiCAT 8108 | | | | | |
| | | DBN | | | | | |
| | | DBU | | | | | |
| | | U-CAT SA1 | | | | | |
| | | Orgatix TC750 | 0.5 | | | | |
| | | Orgatix ZC150 | | 0.5 | | | |
| | | BiCAT Z | | | 0.5 | | |
| | | potassium formate | | | | 0.5 | |
| | | dibutyltin dilaurate | | | | | 0.5 |
| | IPA | | 29.45 | 29.45 | 29.45 | 29.45 | 29.45 |

TABLE 3-continued

| | | | | | | | |
|---|---|---|---|---|---|---|---|
| Cured film evaluations | Ink repellency | Ink 1 | B | C | C | C | A |
| | | Ink 2 | B | C | C | C | B |
| | Wiping resistance | Ink 1 | C | C | C | C | A |
| | | Ink 2 | C | C | C | C | B |

As is evident from Table 3, the nozzle plates obtained in Examples 1 to 6 using prescribed compounds exhibited excellent ink repellency and wiping properties. In contrast, the nozzle plates which used a titanium-based compound (Comparative Examples 2 and 3), a zinc-based compound (Comparative Example 4) or an alkali metal-based compound (Comparative Example 5) were all inferior to those of the examples. The nozzle plate that used a tin-based compound (Comparative Example 6) exhibited similar ink repellency and wiping properties to the examples when the ink 1 was used, but was slightly inferior to the examples for the ink 2.

Accordingly, by using the method of the present invention, a cured film having excellent ink repellency and wiping resistance can be formed on a nozzle plate.

In the examples, oil-based inks were used, but because silicones also exhibit good water repellency, it is thought that the nozzle plate of the present invention would also exhibit excellent ink repellency and wiping resistance for water-based inks.

DESCRIPTION OF THE REFERENCE NUMERALS

1 Nozzle plate

2 Oil-based ink

3 Container

4 Tweezers

10 Nozzle hole

The invention claimed is:

1. A method for forming a silicone-based cured film on an ink discharge surface of a nozzle plate for an inkjet printer, the method comprising:

(1) preparing a condensation-type silicone composition comprising at least one compound selected from the group consisting of bismuth compounds and cyclic amidine compounds, (2) applying the condensation-type silicone composition to the ink discharge surface of the nozzle plate to form a coating film, and (3) heating and curing the coating film, wherein a resin component within the condensation-type silicone composition comprises components listed below:

(A) 100 parts by mass of an organopolysiloxane resin, (B) 1 to 100 parts by mass of a (meth)acrylic-based copolymer containing epoxy groups together with alkoxysilyl groups and/or halogenated silyl groups, and (C) 1 to 100 parts by mass of a linear polysiloxane diol.

2. The method according to claim 1, wherein the cyclic amidine compound is at least one compound selected from the group consisting of diazabicycloundecene and diazabicyclononene.

3. The method according to claim 1, wherein the bismuth compound is a bismuth salt of an organic acid.

4. The method according to claim 1, wherein the at least one compound selected from the group consisting of bismuth compounds and cyclic amidine compounds is added in an amount of 0.1 to 3 parts by mass per 100 parts by mass of a combined total of components (A) to (C).

5. The method according to claim 1, wherein the condensation-type silicone composition comprises cyclic amidine, and the cyclic amidine is diazabicyclononene.

6. A nozzle plate for an inkjet printer, wherein the nozzle plate has a silicone-based cured film on an ink discharge surface of the nozzle plate, and the cured film comprises at least one compound selected from the group consisting of bismuth compounds and cyclic amidine compounds, wherein the silicone-based cured film is made by curing a condensation-type silicone composition which comprises components listed below with at least one compound selected from the bismuth compounds and the cyclic amidine compounds:

(A) 100 parts by mass of an organopolysiloxane resin, (B) 1 to 100 parts by mass of a (meth)acrylic-based copolymer containing epoxy groups together with alkoxysilyl groups and/or halogenated silyl groups, and (C) 1 to 100 parts by mass of a linear polysiloxane diol.

7. The nozzle plate according to claim 6, wherein the cyclic amidine compound is at least one compound selected from the group consisting of diazabicycloundecene and diazabicyclononene.

8. The nozzle plate according to claim 6, wherein the cured film comprises cyclic amidine, and the cyclic amidine is diazabicyclononene.

* * * * *